US009525259B2

(12) United States Patent
Hammond

(10) Patent No.: US 9,525,259 B2
(45) **Date of Patent: *Dec. 20, 2016**

(54) ELECTRICAL CONTACTOR

(71) Applicant: SIEMENS AKTIENGESELLSCHAFT, München (DE)

(72) Inventor: Peter Willard Hammond, Greensburg, PA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/971,065

(22) Filed: Dec. 16, 2015

(65) Prior Publication Data

US 2016/0104992 A1 Apr. 14, 2016

Related U.S. Application Data

(63) Continuation-in-part of application No. 14/242,961, filed on Apr. 2, 2014, now Pat. No. 9,270,069.

(51) Int. Cl.

| | |
|---|---|
| ***H01R 25/00*** | (2006.01) |
| ***H01R 41/00*** | (2006.01) |
| ***H01R 13/24*** | (2006.01) |

(52) U.S. Cl.

CPC ..... *H01R 41/00* (2013.01); *H01R 13/2457* (2013.01); *H01R 13/2478* (2013.01)

(58) Field of Classification Search

CPC ..... H01R 41/00

See application file for complete search history.

(56) References Cited

U.S. PATENT DOCUMENTS

| | | | | |
|---|---|---|---|---|
| 3,553,633 | A * | 1/1971 | Ondrejka | H01R 13/28 439/277 |
| 5,919,055 | A * | 7/1999 | Hattori | H01R 13/62938 439/310 |
| 6,113,440 | A * | 9/2000 | Fijten | H01R 13/2442 439/862 |
| 6,126,496 | A * | 10/2000 | Shinozaki | H01R 13/7033 439/862 |
| 6,613,451 | B1 * | 9/2003 | Asahara | C23C 2/02 205/226 |
| 6,863,540 | B2 * | 3/2005 | Spykerman | H01R 13/2407 439/66 |
| 9,270,069 | B2 * | 2/2016 | Hammond | H01R 41/00 |

(Continued)

*Primary Examiner* — Tho D Ta

(57) ABSTRACT

An electrical contactor includes a first stationary contact bar with first and second contact surfaces, and a single moving contact bar with first and second contact surfaces. The first and second contact surfaces of the first stationary contact bar and the first contact surface of the single moving contact bar are configured such that, when the single moving contact bar travels towards the first stationary contact bar, the first contact surface of the single moving contact bar touches the first contact surface of the first stationary contact bar in a first contact point, and the second contact surface of the first stationary contact bar in a second contact point. At least one of the first and second contact surfaces of the first stationary contact bar or the first contact surface of the single moving contact bar have a convex shape to establish the first and second contact points.

19 Claims, 10 Drawing Sheets

(56) References Cited

U.S. PATENT DOCUMENTS

| | | | | |
|---|---|---|---|---|
| 2005/0181683 | A1* | 8/2005 | Miyamoto | H01R 13/2464 439/862 |
| 2012/0142226 | A1* | 6/2012 | Funayama | H01R 12/716 439/692 |

* cited by examiner

ELECTRICAL CONTACTOR

CROSS REFERENCE TO RELATED APPLICATIONS

This Continuation-in-Part Application claims the benefit of U.S. application Ser. No. 14/242,961, filed 2 Apr. 2014, which is hereby incorporated herein by reference in its entirety.

BACKGROUND

1. Field

The disclosure relates generally to electrical contactors.

2. Description of the Related Art

Low current electrical contactors may be found in various electrical systems, for example, motor starters. In a prior art low-current electrical contactor 100, an example of which is shown in FIG. 1, a moving contact bar 101 is positioned above a left stationary contact bar 102 and a right stationary contact bar 103. The three contact bars 101, 102, and 103 comprise respective contact discs 105A-B, 104A, and 104B. The contact discs are attached to the contact bars, and positioned so that the contact discs on the stationary contact bars 102 and 103 are directly opposed to corresponding contact discs on the moving contact bar 101. When the moving contact bar 101 is moved down toward the stationary contact bars 102 and 103, contact disc 105A approaches and touches contact disc 104A, and contact disc 105B approaches and touches contact disc 104B, closing a circuit between stationary contact bars 102 and 103 so that a current enters stationary contact bar 102 from current input 108 and flows through moving contact bar 101 to stationary contact bar 103, and exits stationary contact bar 103 via current output 109. The moving contact bar 101 is mechanically driven upwards and downwards by an actuating device 107, which transmits motion to the moving contact bar 101 through a spring 106.

As the moving contact bar 101 is mechanically driven toward the stationary contact bars 102 and 103, one pair of contact discs (e.g., 104A and 105A) may touch before the other pair (e.g., 104B and 105B), due to manufacturing tolerances. Therefore the linkage between the actuating device 107 and the moving contact bar 101 must have some flexibility, so that the contact bar 101 can pivot to cause the second pair of contact discs (e.g., 104B and 105B) to touch. The spring 106 may provide part of this flexibility.

The current is constricted as it flows through the points where the contact disc pairs 104A/105A and 104B/105B touch each other. This constriction generates a magnetic force proportional to the square of the current, which acts to drive the contact disc pairs 104A/105A and 104B/105B apart. This force may be referred to as the blow-apart force. During a fault event in electrical contactor 100, which may be caused by, for example, an external short circuit in the electrical system that contains electrical contactor 100, the currents in electrical contactor 100 may exceed a rated current level of the electrical contactor 100. The current is highly concentrated at each point of contact between the contact disc pairs, which may generate a correspondingly large blow-apart force at the point of contact. The spring 106 and the actuating device 107 must provide a closing force substantially greater than the total blow-apart force during a worst-case fault event. Otherwise, high currents may cause the metal that comprises the contact discs to melt at the point of contact, welding the contacts discs together.

SUMMARY

Embodiments of an electrical contactor are provided. An electrical contactor comprises a first stationary contact bar comprising a first contact surface and a second contact surface; and a single moving contact bar comprising a first contact surface and a second contact surface, wherein the first and second contact surfaces of the first stationary contact bar and the first contact surface of the single moving contact bar are configured such that, when the single moving contact bar travels towards the first stationary contact bar, the first contact surface of the single moving contact bar touches the first contact surface of the first stationary contact bar in a first contact point, and the second contact surface of the first stationary contact bar in a second contact point, wherein at least one of the first and second contact surfaces of the first stationary contact bar or the first contact surface of the single moving contact bar comprise a shape to establish the first and second contact points.

Additional features are realized through the techniques of the present exemplary embodiment. Other embodiments are described in detail herein and are considered a part of what is claimed. For a better understanding of the features of the exemplary embodiment, refer to the description and to the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

With reference to FIGS. 2A, 2B, 3, 4 and 5, embodiments of an angled electrical contactor are provided, with exemplary embodiments being discussed below in detail. Electrical contactors that are rated for use in high current applications (for example, above about 500 amperes) may provide more than one parallel path for the current. Dividing the current among two or more parallel paths reduces the blow-apart force, and also reduces the likelihood of a welding event during a fault. Because each path carries only half of the current during a fault event, the blow-apart force per path where the contact discs touch is reduced by a factor of four, and the closing force required from the actuating device and the spring is reduced by a factor of two. For an electrical contactor that includes two parallel paths, the moving contact bar may be made wider to accommodate two contact discs at each end; the stationary contact bar(s) may also be made wider to include contact discs corresponding to the contact discs on the moving contact bar. However, achieving good, substantially simultaneous contact between four separate pairs of contact discs in an electrical contactor that comprise flat moving and stationary contact bars may be difficult due to manufacturing tolerances; for example, when three of the contact disc pairs are in contact, it may not be possible to maneuver the moving contact bar so that the fourth contact disc pair comes into contact. Therefore, the moving contact bar may be configured such that the contact discs at each end are at an angle to one another, with the contact discs on the stationary contact bars configured at a corresponding angle. In such an angled configuration, when three of the contact disc pairs are in contact with one another, it is still possible to maneuver the moving contact bar so that the fourth contact disc pair comes into contact.

Figure 1:
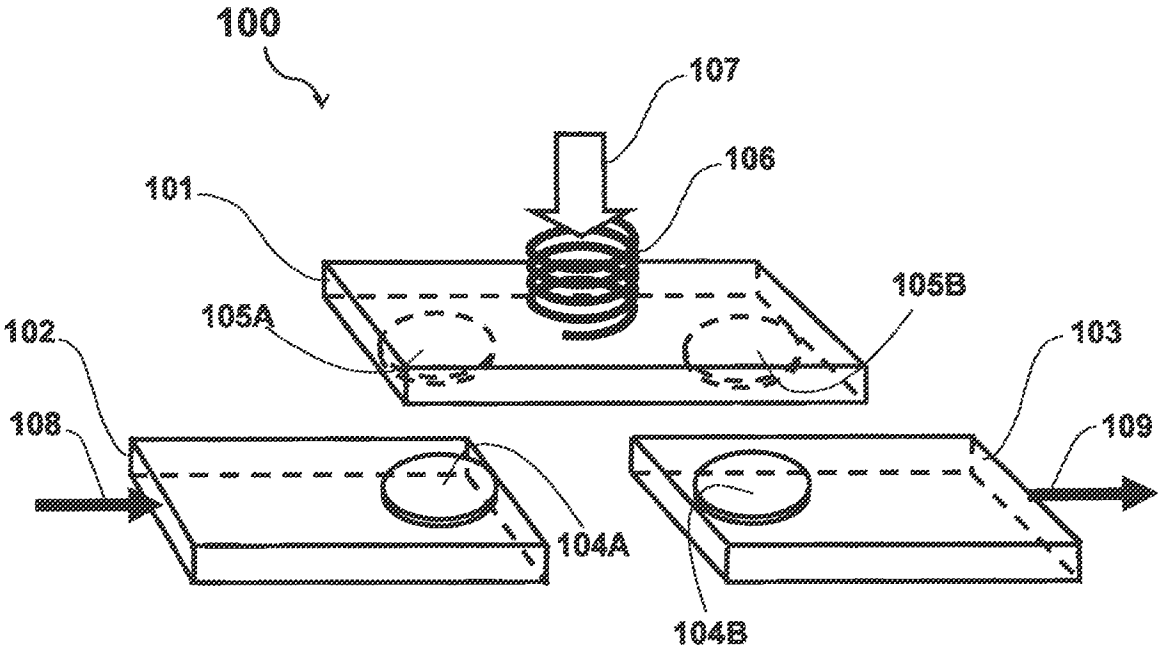
FIG 1 PRIOR ART
FIG. 1 illustrates an embodiment of a prior art electrical contactor.
Figure 2A:
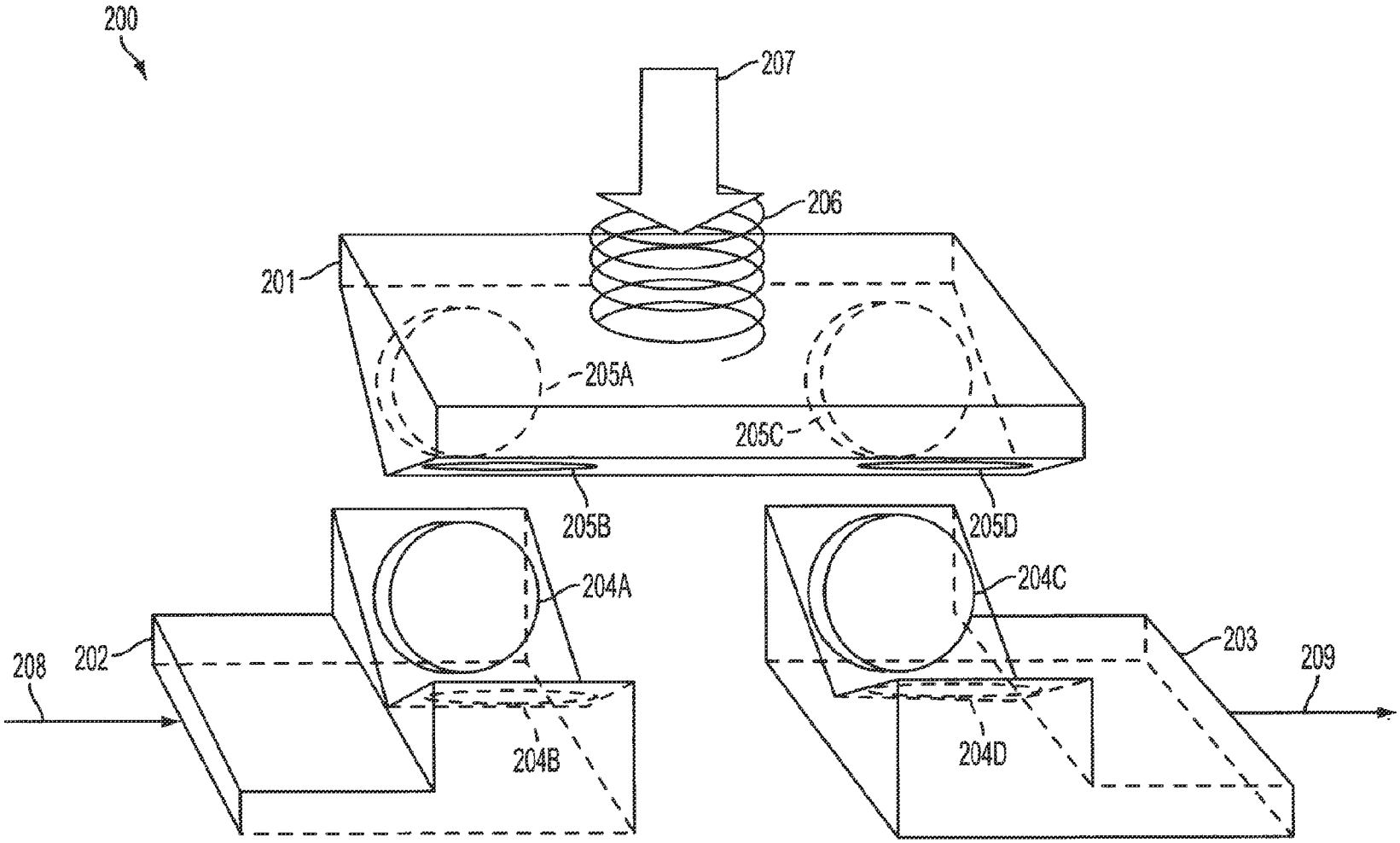
FIG. 2A illustrates an embodiment of an angled electrical contactor.

FIG. 2A shows an embodiment of an angled electrical contactor 200. The angled electrical contactor 200 comprises a moving contact bar 201 that is moved towards or away from stationary contact bars 202 and 203 by an actuating device 207 and a spring 206. The angled electrical contactor 200 provides two parallel current paths; the first through contact disc pairs 205A/204A and 205C/204C, and the second through contact disc pairs 205B/204B and 205D/204D. The four contact discs 205A-D on the moving contact bar 201 are not all in the same plane; rather, contact discs 205A and 205C are in a first plane, and contact discs 205B and 205D are in a second plane that is at an angle to the first plane. The two stationary contact bars 202 and 203 also have their respective contact discs 204A-D arranged in two planes that are at an angle to each other corresponding to the angle between the first and second planes on the moving contact bar 201; e.g., contact disc 204A and contact disc 204C are in a third plane that is substantially parallel to the first plane, and contact disc 204B and contact disc 204D are in a fourth plane that is substantially parallel to the second plane. The actuating device 207 moves the moving contact bar 201 via spring 206 upwards to put the angled electrical contactor 200 in the off position, and downwards to put the angled electrical contactor 200 in the on position. When the angled electrical contactor 200 is in the on position, current is input to the angled electrical contactor 200 via stationary contact bar 202 via current input 208, flows through from stationary contact bar 202 to moving contact bar 201 via contact discs 204A-B and 205A-B, from moving contact bar 201 to stationary contact bar 203 via contact discs 204C-D and 205C-D, and out of stationary contact bar 203 via current output 209. Angled electrical contactor 200 allows the moving contact bar 201 to move in four degrees of freedom (vertical, roll, pitch, and yaw), to achieve good contact between the contact discs 205A-D on moving contact bar 201 and contact discs 204A-D on stationary contact bars 202 and 203. Even if manufacturing tolerances prevent all four disc pairs from touching on the initial descent, there are three degrees of freedom remaining for moving contact bar 201 to move so as to allow all remaining disc pairs to touch. The moving contact bar 201 may have some flexibility, so that the contact bar 201 can pivot to utilize roll, pitch, and yaw movement. In some embodiments, a plurality of springs may be included in an angled electrical contactor instead of the single spring 206 shown in FIG. 2.

The actuating device 207 provides the holding force between the moving contact bar 201 and stationary contact bars 202 and 203 when the angled electrical contactor is in the on position (i.e., can conduct current), and may be any appropriate actuating mechanism, for example, an electric solenoid, a manually operated lever, a cam and roller, or a pneumatic cylinder, in various embodiments. The actuating device 207 may travel a fixed distance, somewhat greater than the separation between the moving contact bar 201 and the stationary contact bars 202 and 203. The excess travel acts to compress the spring 206, which is dimensioned to provide a holding force on the moving contact bar 201. Each of the four contact discs 205A-D is therefore pressed against the opposing contact discs 204A-D with more than one-fourth of the holding force from the spring 206. As will be described below, the total force between the opposing contact discs is greater than the holding force. The contact bars 201-203 may be made from a metal with a relatively low electrical resistance, such as copper, in some embodiments. The contact discs 204A-D and 205A-D may be made from a metal that resists tarnishing, such as silver or cadmium, in some embodiments. In other embodiments, the contact discs 204A-D and 205A-D may be made from a metal with a relatively high melting point, such as tungsten.

Figure 2B:
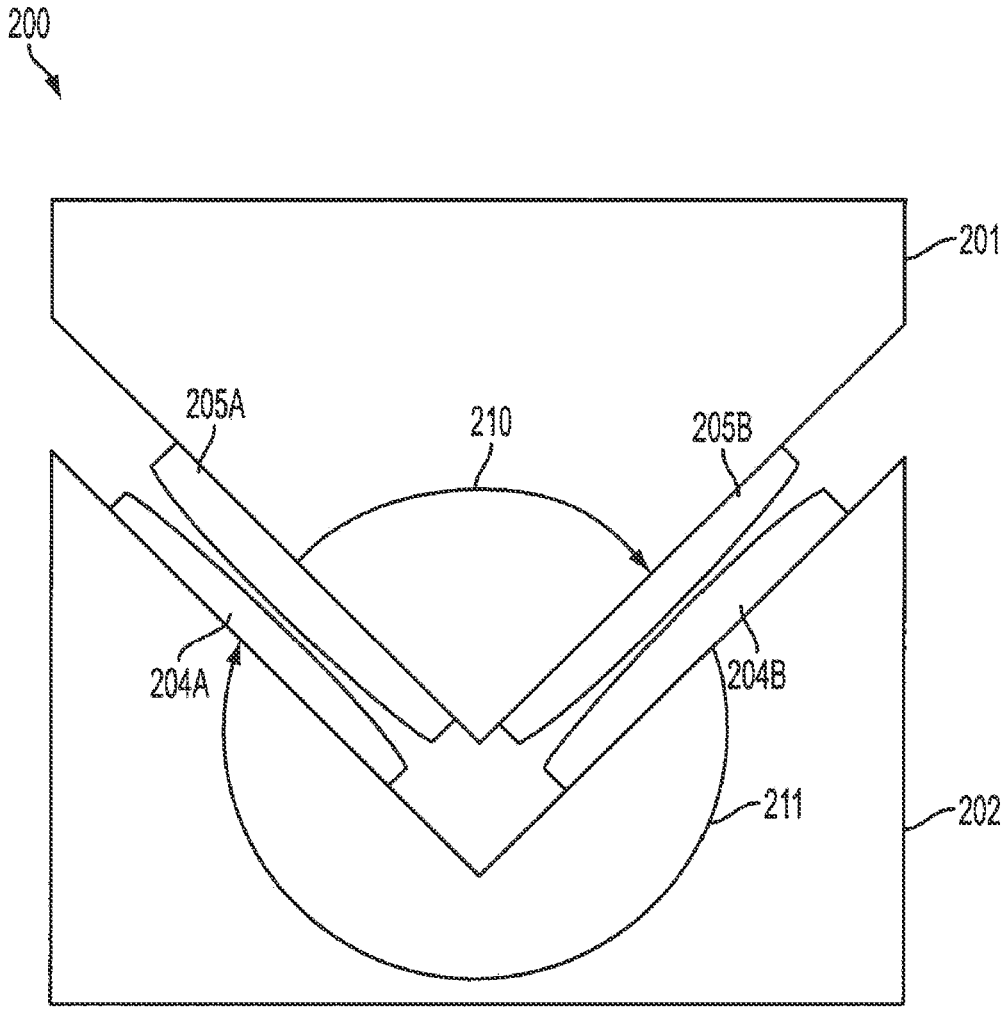
FIG. 2B illustrates a side view of the angled electrical contactor of FIG. 2A.

FIG. 2B shows a side view of the angled electrical contactor 200 that shows the points where the contact discs 204A and 205A on moving contact bar 201, and contact discs 204B and 205B on stationary contact bar 202, contact each other when the angled electrical contactor 200 is in the on position. The contact discs 204A-B and 205A-B as shown in FIG. 2B have a slightly domed or convex surface, which causes the contact point to be near the center of the discs. Angle 210 is the angle between the plane surface containing contact disc 205A and the place surface containing contact disc 205B on the moving contact bar 201. Angle 210 is shown as 90° degrees in FIG. 2B, but in various embodiments, angle 210 may be any angle that is greater than 0° but less than 180°. In some embodiments, angle 210 is between about 60° and 120°. On stationary contact bar 202, contact disc 204A is in a plane that is at an angle 211 with respect to the plane containing contact disc 204B. Angle 211 corresponds to angle 210 and is approximately equal to 360° minus angle 210. In an embodiment in which angle 210 is about 90°, the moving contact bar 201 must travel about 41% farther, as compared to an embodiment comprising flat moving and stationary contact bars, to achieve the same contact gap when the angled electrical contactor 200 is in the off position. However, the total closing force between the contact discs 204A-D and 205A-D is 41% greater than the force from spring 206 in such an embodiment, due to the wedging effect. This increased closing force improves the ability of the angled electrical contactor 200 to avoid welding. In embodiments in which the angle 210 is more acute, the extra travel that is required and the extra force that is generated both increase. Further embodiments of angled electrical contactors that incorporate a moving contact bar that is angled similarly to moving contact bar 201 of FIGS. 2A-B, and one or more stationary contact bars that are angled similarly to stationary contact bars 202-203, are discussed below with respect to FIGS. 3-5.

Figure 3:
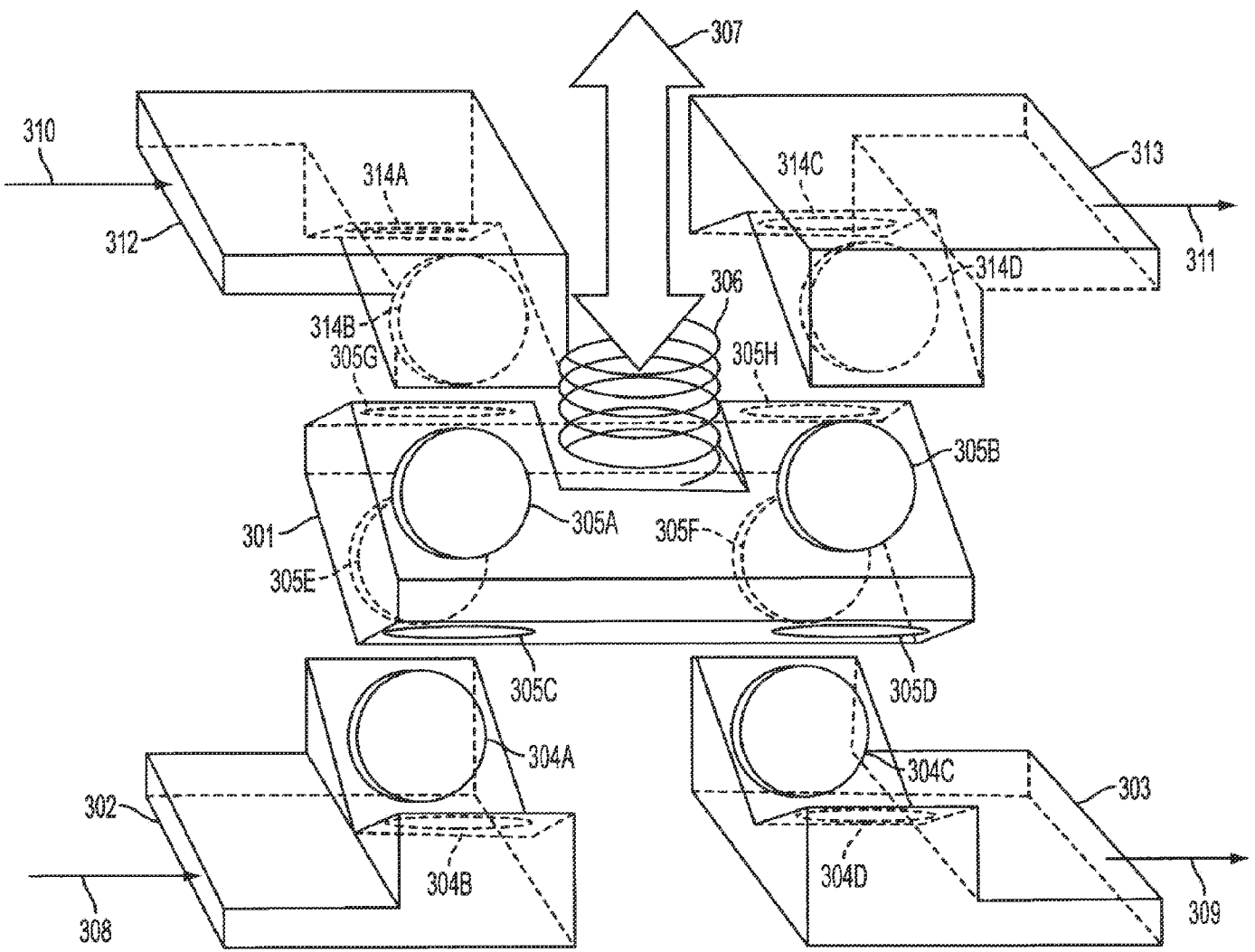
FIG. 3 illustrates an embodiment of a single-pole double-throw contactor comprising an angled electrical contactor.

FIG. 3 illustrates an embodiment of a single-pole double-throw contactor 300 comprising an angled electrical contactor as shown in FIGS. 2A-B. In single-pole double-throw contactor 300 there are four stationary contact bars, 302 and 303 below, and 312 and 313 above. The moving contact bar 301 has four separate plane surfaces, each plane surface comprising two respective contact discs of contact discs 305A-H. A first plane containing contact discs 305A-B is at an angle with respect to a second plane containing contact discs 305G-H; a third plane containing contact discs 305C-D is at approximately the same angle with respect to a fourth plane containing contact discs 305E-F. The first and third planes are substantially parallel, as are the second and fourth planes. The four stationary contact bars 302, 303, 312, and 313 each have two respective contact discs 304A-B, 304C-D, and 314A-B, and 314C-D; on each stationary contact bar 302, 303, 312, and 313, the contact discs are mounted on two different planes that are substantially parallel to the plane surfaces of the moving contact bar 301 that contact the particular stationary contact bar. When the actuating device 307 drives the moving contact bar 301 downwards via spring 306 towards stationary contact bars 302 and 303, the moving contact bar 301 closes the circuit between stationary contact bars 302 and 303, and current can flow from current input 308 through stationary contact bars 302 and 303 via moving contact bar 301, through contacts discs 304A-D and contact discs 305C-F, to current output 309. When the actuating device 307 drives the moving contact bar 301 upwards via spring 306 towards stationary contact bars 312 and 313, the moving contact bar 301 closes the circuit between stationary contact bars 312 and 313, and current flows from current input 310 through stationary contact bars 312 and 313 via moving contact bar 301, through contacts discs 314A-D and contact discs 305A-B and 305G-H, to current output 311. In embodiments of a single-pole double-throw contactor 300, the actuating device 307 is configured to be capable of generating the same amount of force in both the downwards and upwards directions.

Figure 4:
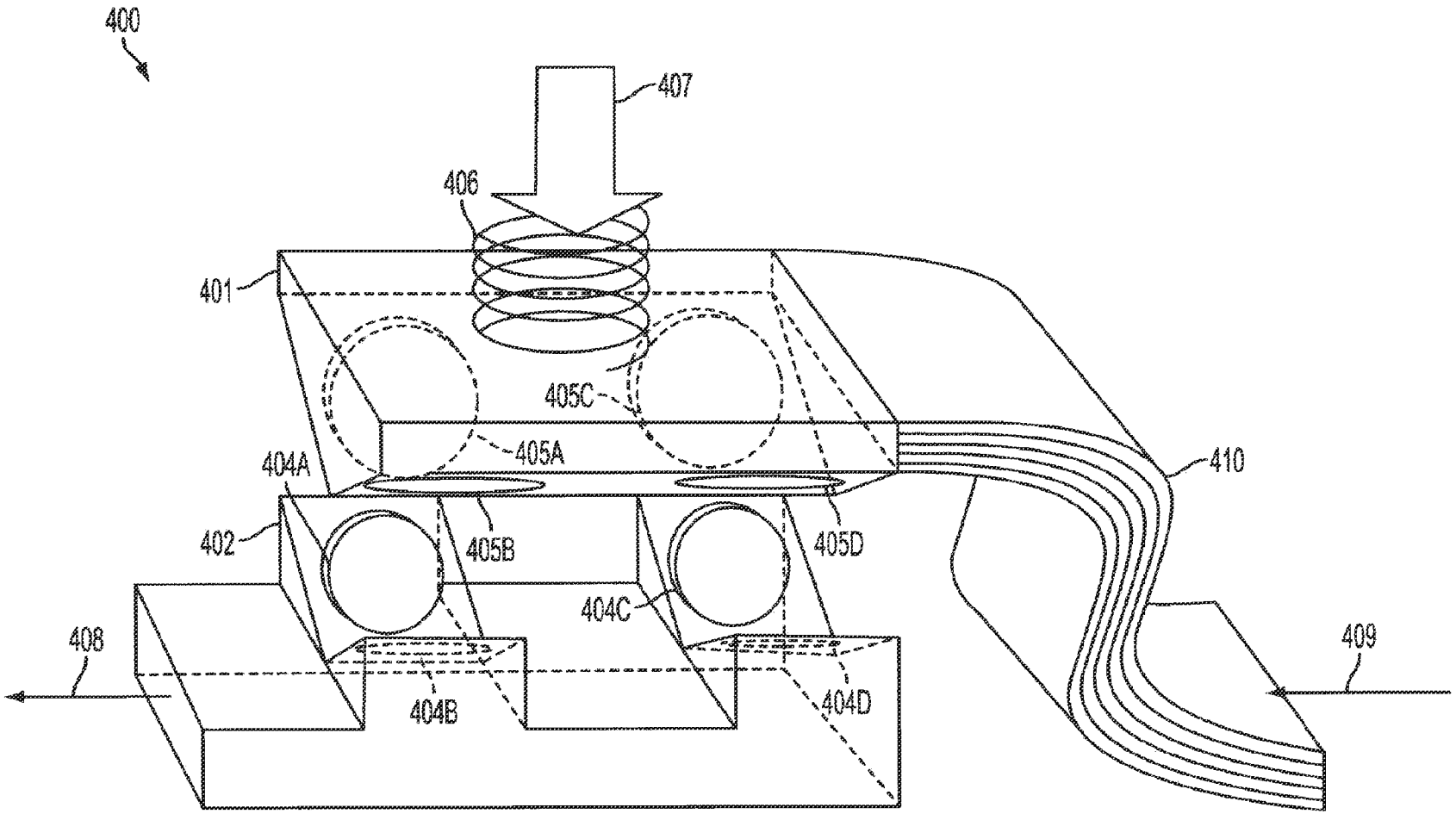
FIG. 4 illustrates another embodiment of an angled electrical contactor.

FIG. 4 shows another embodiment of an angled electrical contactor 400. The angled electrical contactor 400 comprises a moving contact bar 401 moved upwards and downwards by actuating device 407 and spring 406. The angled electrical contactor 400 provides four parallel current paths; the first through contact disc pair 404A/405A, the second through contact disc pair 404B/405B, the third through contact disc pair 404C/405C, and the fourth through contact disc pair 404D/405D. The four contact discs 405A-D on the moving contact bar 401 are not all in the same plane; rather, contact discs 405A and 405C are in a first plane, and contact discs 405B and 405D are in a second plane that is at an angle to the first plane. The stationary contact bar 402 also has contact discs 404A-D arranged in two planes that are at an angle to each other that corresponds to the angle of the contacts discs 405A-D on the moving contact bar 401. The actuating device 407 moves the moving contact bar 401 upwards via the spring 406 to put the angled electrical contactor 400 in the off position, and downwards to put the angled electrical contactor 400 in the on position. Flexible conductor 410 inputs current to the angled electrical contactor 400. When the angled electrical contactor 400 is in the on position, current is input to the angled electrical contactor 400 via moving contact bar 401 via current input 409 and flexible conductor 410, flows through moving contact bar 401 to the stationary contact bar 402 via contact discs 404A-D and 405A-D, and out at current output 408. FIG. 4 is shown for illustrative purposes only; in some embodiments, current may be input to the stationary contact bar, and output by the moving contact bar.

Figure 5:
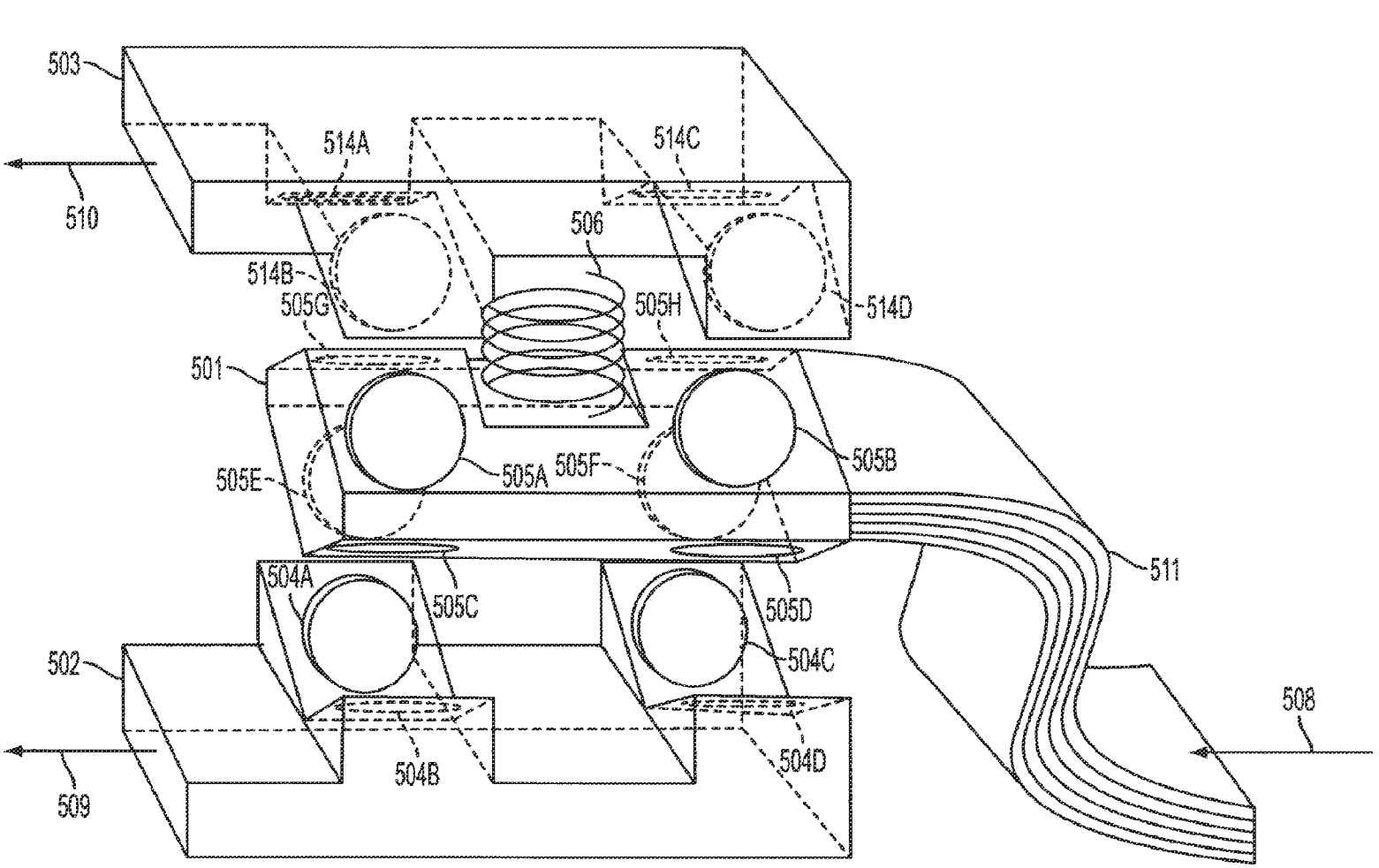
FIG. 5 illustrates another embodiment of a single-pole double-throw contactor comprising an angled electrical contactor.

FIG. 5 illustrates an embodiment of a single-pole double-throw contactor 500 comprising an angled electrical contactor as shown in FIG. 4. In single-pole double-throw contactor 500 there are two stationary contact bars, 502 below, and 503 above. The moving contact bar 501 has four separate plane surfaces, each plane surface comprising two respective contact discs of contact discs 505A-H. A first plane containing contact discs 505A-B is at an angle with respect to a second plane containing contact discs 505G-H; a third plane containing contact discs 505C-D is at approximately the same angle with respect to a fourth plane containing contact discs 505E-F. The two stationary contact bars 502 and 503 each have four respective contact discs 504A-D and 514A-D on each stationary contact bar 502 and 503, the contact discs are mounted on two planes are at an angle that corresponds to the above-listed planes on moving contact bar 501. Moving contact bar 501 is moved upwards and downwards via spring 506 and an actuating device such as actuating device 307 that was shown in FIG. 3. Flexible conductor 511 supplies current to the single-pole double-throw contactor 500. When the actuating device drives the moving contact bar 501 downwards via spring 506, the moving contact bar 501 comes into contact with stationary contact bar 502, and current flows from current input 508 and flexible conductor 511 through moving contact bar 501, through contacts discs 505C-F and contact discs 504A-D to stationary contact bar 502, and out at current output 509. When the actuating device moves the moving contact bar 501 upwards via spring 506, the moving contact bar 501 comes into contact with stationary contact bar 503, and current flows from current input 508 and flexible conductor 511 through moving contact bar 501, through contact discs 505A-B and 505G-H to contacts discs 514A-D to stationary contact bar 503, and out at current output 510. FIG. 5 is shown for illustrative purposes only; in some embodiments, current may be input to the stationary contact bars, and output from the moving contact bar via the flexible conductor.

The embodiments of an angled electrical contactor as described in FIGS. 2A, 2B, 3, 4 and 5 provide for example that a single moving contact bar, comprising at least two contact discs at each end, can make simultaneous contact with further contact discs of two or more stationary contact bars, said further contact discs being attached to each end of the two or more stationary contact bars, if the mating pairs of moving and stationary contact discs are in distinct planes at an angle to each other. The described contact discs can be silver or tungsten, or a mixture of several metals, selected to resist tarnishing and corrosion, and to maximize the number of contactor operations before servicing is required. These discs generally have one flat surface and one slightly convex surface. The convex surface of one contact disc touches the convex surface of a mating contact disc, which assures that the point where the two discs touch will be near the center of the discs. The flat surface of each disc is generally attached to the moving contact bar or to the stationary contact bar by soldering or brazing. The surface of the moving and stationary contact bars where the contact discs are attached must therefore be planar.

However, there are circumstances for which the contact discs are not required, such as when a contactor does not make or break any current. In that case the protection against corrosion can be provided by a thin plating of silver, at much less cost. If the contact discs, as described for example in FIGS. 2A, 2B, and 3-5, were simply omitted, then the planar surfaces of the moving and stationary contact bars, where the contact discs had previously been installed, would need to touch each other directly. When two planar surfaces touch each other, the actual point of contact is not determined. Therefore at least one of the mating surfaces of the moving and/or the stationary contact bars cannot be planar, and must be convex.

With reference to FIGS. 6A-C, 7, 8A-C and 9, possible embodiments of an alternative electrical contactor are provided, with exemplary embodiments being discussed below in detail.

Figure 6A:
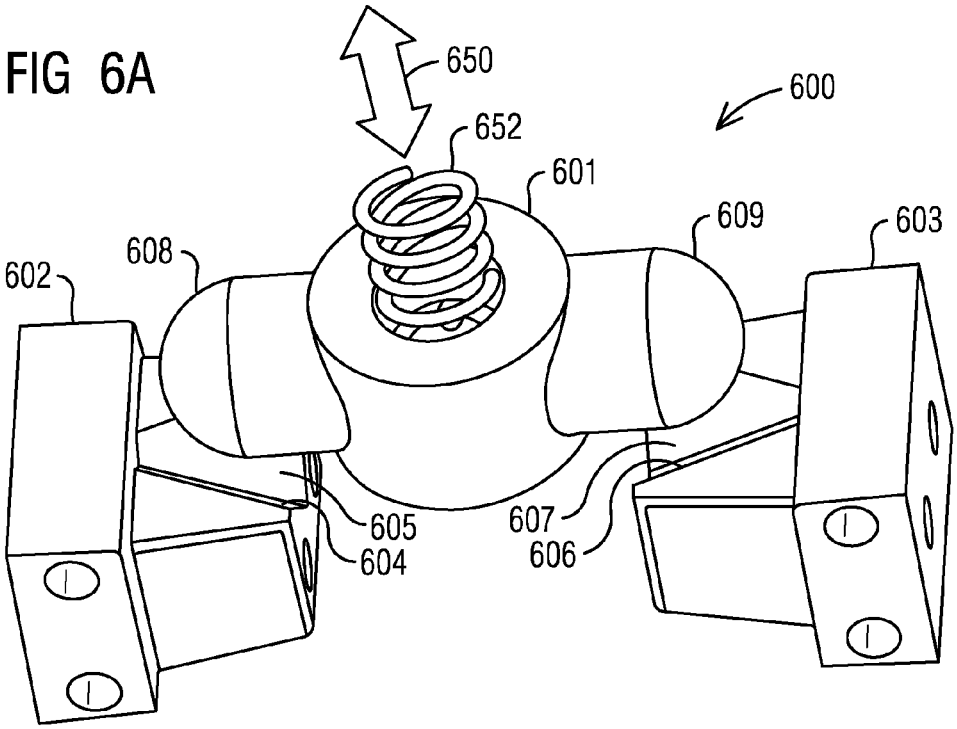
FIG. 6A illustrates a perspective view of an embodiment of a single-throw contactor with convex-to-plane contact surfaces in an open position.

FIG. 6A illustrates a perspective view of an embodiment of a single-throw contactor 600 with convex-to-plane contact surfaces in an open position. The electrical contactor 600 comprises a single moving contact bar 601 that is moved towards or away from first and second stationary contact bars 602 and 603 by an actuating device 650, which is only shown schematically.

Each stationary contact bar 602 and 603 comprises first and second contact surfaces which are planar and at an angle to each other. Stationary contact bar 602 comprises first plane 604 and second plane 605, and stationary contact bar 603 comprises first plane 606 and second plane 607. In other words, each stationary contact bar 602 and 603 comprises angled surfaces which are planar. An angle between planes 604 and 605 of stationary contact bar 602 may be any angle that is greater than 0° but less than 180°. In some embodiments, the angle is between about 60° and 120°, for example 90°. An angle between planes 606 and 607 of stationary contact bar 603 is substantially identical to an angle between planes 604, 605 of stationary contact bar 602.

If the corresponding surfaces of the moving contact bar 601 were also planar, the actual points of contact would not be determined. Therefore, the first and second surfaces 604, 605, 606, 607 of the stationary contact bars 602, 603 and/or contact surfaces of the single moving contact bar 601 comprise a convex shape in order to establish the contact points. In FIG. 6A this convex shape is a hemisphere 608 and 609, but other shapes are also possible.

In FIG. 6A, the moving contact bar 601, when moved towards the stationary contact bars 602, 603, is able to contact both stationary contact bars 602, 603 at a plurality of contact points. In particular, the contact bar 601 contacts each stationary contact bar 602, 603 in two contact points, which results in four contact points in total, that is one contact point per each plane 604, 605 and 606, 607 (see also FIG. 6C).

As discussed above, because the stationary contact bars 602, 603 comprise angled planar surfaces, surface(s) of the moving contact bar 601 cannot be planar. According to the exemplary embodiment of FIG. 6A, the single moving contact bar 601 comprises two ends, wherein a first end comprises a first contact surface and a second end comprises a second contact surface, the first and second contact surfaces being convex. For example, the first end comprising the first contact surface is configured as hemisphere 608, and the second end comprising the second surface is configured as hemisphere 609. Such a configuration provides achieving four points of contact with a single moving contact bar 601. Specifically, between each stationary contact bar 602, 603 and the single moving contact bar 601 two points of contact are established.

Figure 6B:
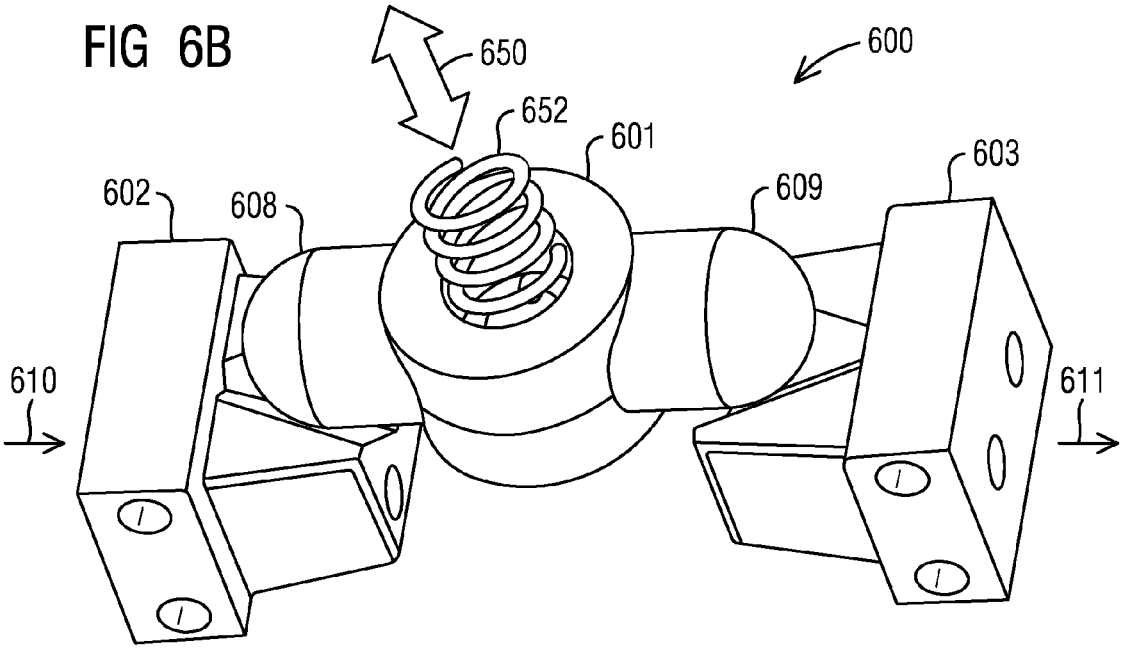
FIG. 6B illustrates a perspective view of the embodiment of FIG. 6A in a closed position.

FIG. 6B illustrates a perspective view of the embodiment of FIG. 6A with the contactor 600 in a closed position, herein also referred to as the on position. Actuating device 650, only shown schematically, moves the moving contact bar 601 upwards to put the electrical contactor 600 in the off position (see FIG. 6A), and downwards to put the electrical contactor 600 in the on position. When the electrical contactor 600 is in the on position, current is input to the electrical contactor 600 via current input 610, flows from stationary contact bar 602 to moving contact bar 601, from moving contact bar 601 to stationary contact bar 603, and out of stationary contact bar 603 via current output 611.

The actuating device 650 provides the holding force between the moving contact bar 601 and stationary contact bars 602 and 603 when the electrical contactor 600 is in the on position, i.e., is conducting current, and may be any appropriate actuating mechanism, for example, an electric solenoid, a manually operated lever, a cam and roller, or a pneumatic cylinder, in various embodiments with or without a spring 652. The actuating device 650 may travel a fixed distance, which may be somewhat greater than the separation between the moving contact bar 601 and the stationary contact bars 602 and 603, if the spring 652 is present.

Figure 6C:
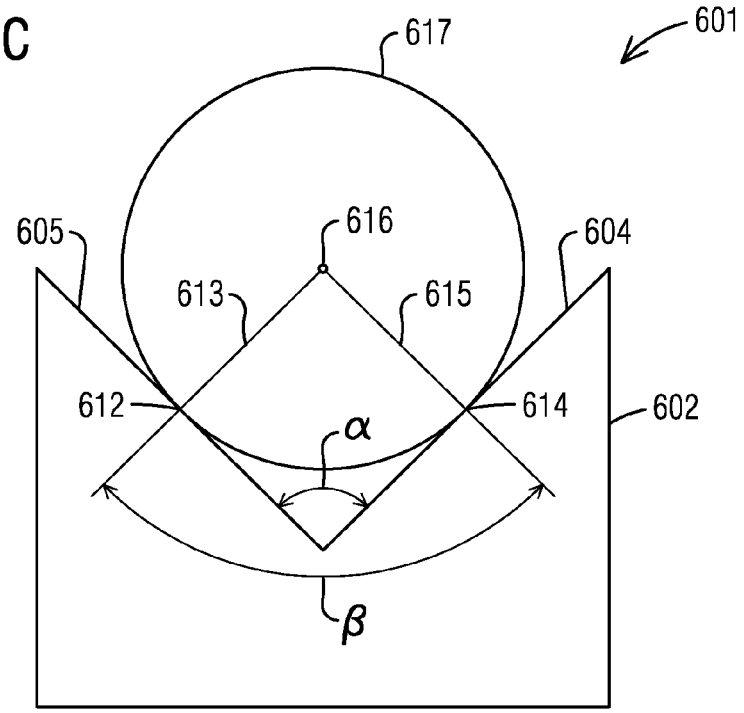
FIG. 6C illustrates a sectional view through the points of contact in the single-throw contactor of FIG. 6B in a closed position.

FIG. 6C illustrates a sectional view through points of contact 612, 614 between the moving contact bar 601 and one of the stationary contact bars 602, 603 of the electrical contactor 600 when in the closed position (see FIG. 6B). In particular, FIG. 6C illustrates contact points 612, 614 where the moving contact bar 601 and stationary contact bar 602 contact each other when the contactor 600 is in the closed position.

When the contactor 600 is in the closed position, i.e., the on position, the moving contact bar 601, in particular hemisphere 608, and stationary contact bar 602 contact each other at contact points 612 and 614. Line 613 illustrates a line normal with regard to contact point 612, i.e., line 613 is perpendicular to an imaginary plane tangent to the convex surface at point 612. Line 615 illustrates a line normal with regard to contact point 614. Lines 613 and 615 intersect at point 616 which can be for example the center of circular section plane 617. However, if non-symmetrical convex shapes were chosen for 608 and 609, the intersection of lines 613 and 615 may not occur at the center, or the lines 613 and 615 may not intersect at all.

Angle β is the angle between lines 613 and 615 for symmetrical embodiments. As noted before, if non-symmetrical convex shapes were chosen for the moving contact bar 601, lines 613 and 615 may not intersect at all (and thus no angle β would exist). Depending on the dimensions of the moving contact bar 601, in particular of the hemisphere 608, for example diameter of the hemisphere 608, the contact points 612 and 614 may lie anywhere in the planes 604 and 605 of the stationary contact bar 602. Angle β may be any angle that is greater than 0° but less than 180°.

Angle α is the angle between the contact surfaces 604, 605 of stationary contact bar 602. As described before, angle α may be shown as 90° degrees, but in various embodiments, may be any angle that is greater than 0° but less than 180°, in particular between about 1° and about 179°. The sum of angles α and β is always 180°, if angle exists.

When the moving contact bar 601 reaches the on position, the moving contact bar 601 and the stationary contact bar 602 contact each other at contact points 612, 614, the moving contact bar 601 and stationary contact bar 603 also contact each other at two contact points. The electrical contactor 600 provides two parallel current paths. The first current path is through stationary contact bar 602 and moving contact bar 601 via contact point 612 and via a corresponding contact point between moving contact bar 601 and stationary contact bar 603. The second current path is through stationary contact bar 602 and moving contact bar 601 via contact point 614 and a corresponding contact point between moving contact bar 601 and stationary contact bar 603.

Figure 7:
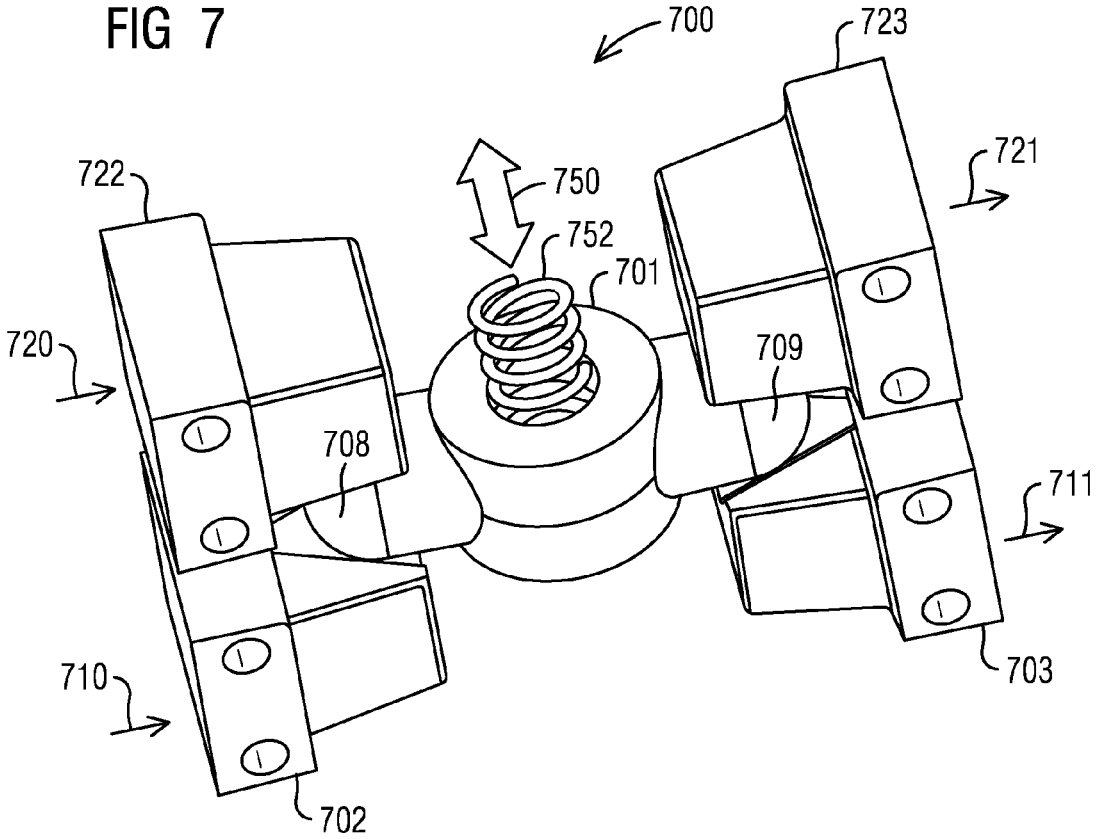
FIG. 7 illustrates a perspective view of an embodiment of a double-throw contactor with convex-to-plane contact surfaces.

FIG. 7 illustrates a perspective view of an embodiment of a double-throw contactor 700 with convex-to-plane contact surfaces. The double-throw contactor 700 comprises moving and stationary contact bars as shown in FIGS. 6A-C. The contactor 700 comprises four stationary contact bars, i.e., first and second stationary contact bars 702, 703 below, and third and fourth stationary contact bars 722, 723 above. A single moving contact bar 701 includes first and second contact surfaces provided by first and second hemispheres 708, 709, one at each end of the moving contact bar 701. The four stationary contact bars 702, 703, 722 and 723 each have two planes, i.e. contact surfaces, arranged at an angle to each other. For example, stationary contact bar 702 has planes 704, 705 angled to each other. As FIG. 7 shows, each other stationary contact bar 703, 722 and 723 has two angled surfaces which are planar.

When actuating device 750 drives the moving contact bar 701 downwards towards stationary contact bars 702 and 703, the moving contact bar 701 closes the circuit between stationary contact bars 702 and 703, and current flows from current input 710 through stationary contact bars 702 and 703 via moving contact bar 701, through four contacts points to current output 711. When the actuating device 750 drives the moving contact bar 701 upwards towards stationary contact bars 722 and 723, the moving contact bar 701 closes the circuit between stationary contact bars 722 and 723, and current flows from current input 720 through stationary contact bars 722 and 723 via moving contact bar 701, through four contacts points, to current output 721. In embodiments of a double-throw contactor 700, the moving contact bar 701 is configured to control eight points of contact. The actuating device 750 is configured to be capable of generating the same amount force in both the downwards and upwards directions.

The actuating device 750 may be any appropriate actuating mechanism, for example, an electric solenoid, a manually operated lever, a cam and roller, or a pneumatic cylinder, in various embodiments with or without a spring 752.

With further reference to FIGS. 6A-C and 7, the contact bars 601, 602, 603, 701, 702, 703, 722 and 723 may be made from a metal with a relatively low electrical resistance, such as copper, in some embodiments. Since the contact bars 601, 602, 603, 701, 702, 703, 722 and 723 are not required to make or break any current, contact discs as described in the embodiments of FIGS. 2A, 2B, and 3-5 can be replaced by a protective metal plating to save cost. Metals such as silver, gold, or tin are often used for such a protective metal plating. A thin protective metal plating is sufficient to prevent corrosion and ensure contact and flow of current between the contact bars 601, 602, 603, 701, 702, 703, 722 and 723. For example, the moving contact bar 601, 701 can comprise a protective metal plating. In some embodiments, only the hemispheres 608,708, 609,709 of the moving contact bar 601, 701 can comprise a protective metal plating. Also, the angled planes of each stationary contact bar 602, 702, 603, 703, 722, 723 can comprise a protective metal plating. In some embodiments, the complete stationary contact bars 602, 603 can comprise a protective metal plating. In other embodiments, the protective metal plating may be confined to the immediate region of the points of contact.

Figure 8A:
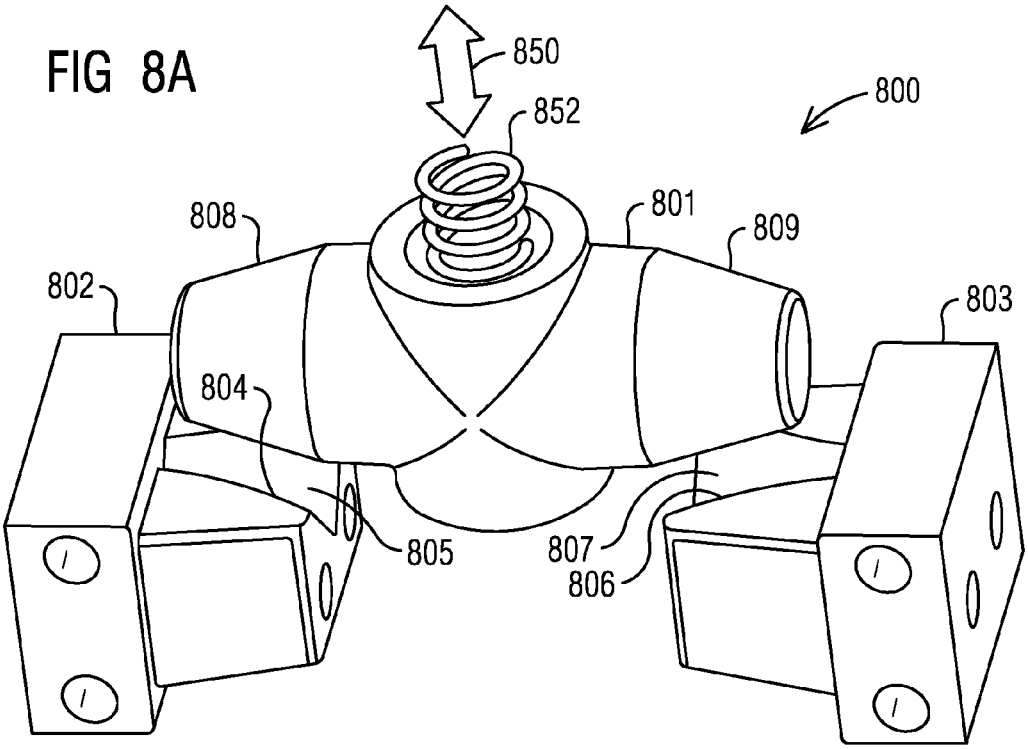
FIG. 8A illustrates a perspective view of an embodiment of a single-throw contactor with convex-to-convex contact surfaces in an open position.

FIG. 8A illustrates a perspective view of an embodiment of a single-throw contactor 800 with convex-to-convex contact surfaces, shown in an open position. The electrical contactor 800 comprises a single moving contact bar 801 that is moved towards or away from first and second stationary contact bars 802 and 803 by an actuating device 850 (only shown schematically).

Each stationary contact bar 802 and 803 comprises two angled contact surfaces which are convex. First stationary contact bar 802 comprises convex contact surfaces 804 and 805, and second stationary contact bar 803 comprises convex contact surfaces 806 and 807.

An angle between surfaces 804 and 805 of stationary contact bar 802 may be any angle that is greater than 0° but less than 180°. Because the surfaces 804 and 805 comprise a convex shape, the angle between the surfaces 804 and 805 is the angle between two imaginary planes tangent to surfaces 804 and 805 respectively, at the two points where the contact surfaces 804 and 805 touch the moving contact bar 801 when in the on position. An angle defined in the same way between surfaces 806 and 807 of stationary contact bar 803 is substantially identical to an angle between surfaces 804, 805 of stationary contact bar 802, so that the moving contact bar 801, when moved into the on position (i.e., towards the stationary contact bars 802, 803), is able to contact both surfaces of both the stationary contact bars 802, 803. The angle between surfaces 806 and 807 is the angle between two imaginary planes tangent to surfaces 806 and 807 respectively, at the two points where the contact surfaces 806 and 807 touch the moving contact bar 801 when in the on position. The angle between surfaces 806, 807 and the angle between surfaces 804, 805 are measured at substantially corresponding lines where the imaginary planes intersect for convex surfaces 804, 805 and for convex surfaces 806, 807.

Figure 8B:
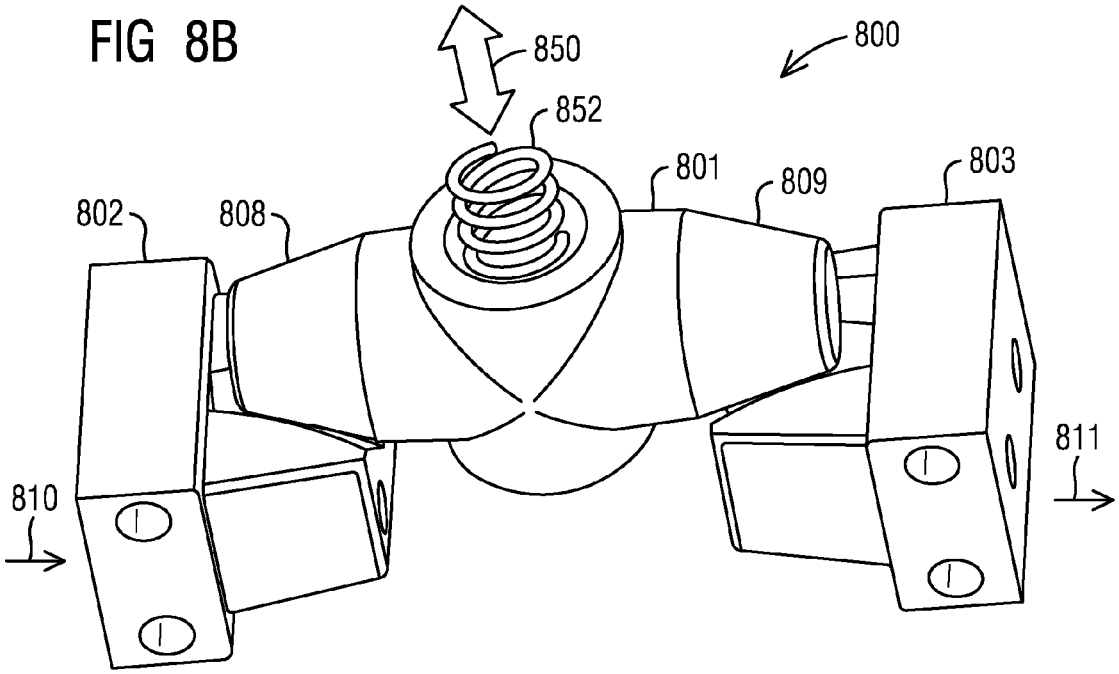
FIG. 8B illustrates a perspective view of the embodiment of FIG. 8A in a closed position.
Figure 8C:
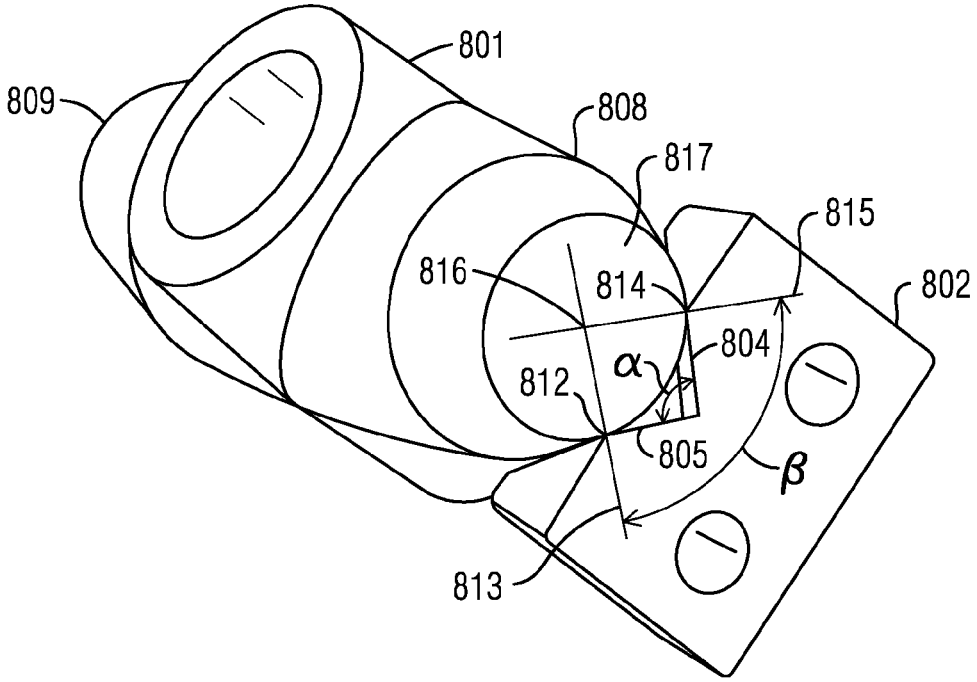
FIG. 8C illustrates a perspective sectional view through the points of contact of the single-throw contactor of FIG. 8B in a closed position.

The moving contact bar 801 contacts each stationary contact bar 802 and 803 in two points of contact, which results in four contact points in total, that is one contact point per each convex surface 804, 805 and 806, 807 (see also FIG. 8C). In an exemplary embodiment, a pair of convex surfaces 804, 805 of a stationary contact bar 802 can be part of a cylinder.

According to the exemplary embodiment of FIG. 8A, the single moving contact bar 801 comprises two ends, wherein each end comprises a convex contact surface and can be configured as part of a cone, in particular as a truncated cone 808, 809. The configuration according to FIG. 8A provides achieving four points of contact between stationary and moving contact bars 801, 802, 803 with a single moving contact bar 801.

FIG. 8B illustrates a perspective view of the embodiment of FIG. 8A in a closed position, herein also referred to as on position. Actuating device 850 moves the moving contact bar 801 upwards to put the electrical contactor 800 in the off position (see FIG. 8A), and downwards to put the electrical contactor 800 in the on position. When the electrical contactor 800 is in the on position, current is input to the electrical contactor 800 via current input 810, flows from stationary contact bar 802 to moving contact bar 801, from moving contact bar 801 to stationary contact bar 803, and out of stationary contact bar 803 via current output 811.

The actuating device 850 provides the holding force between the moving contact bar 801 and stationary contact bars 802 and 803 when the electrical contactor 800 is in the on position, i.e., is able to conduct current, and may be any appropriate actuating mechanism, for example, an electric solenoid, a manually operated lever, a cam and roller, or a pneumatic cylinder, in various embodiments with or without a spring 852. The actuating device 850 may travel a fixed distance, which may be somewhat greater than the separation between the moving contact bar 801 and the stationary contact bars 802 and 803, if the spring 852 is present.

FIG. 8C illustrates a perspective section view through the points of contact of contactor 800 of FIGS. 8A-B when in a closed position (see FIG. 8B). FIG. 8C illustrates contact points 812, 814 where the moving contact bar 801 and stationary contact bar 802 contact each other when the contactor 800 is conducting current.

When the contactor 800 is in a closed position, the moving contact bar 801, in particular truncated cone 808, and stationary contact bar 802 contact each other at contact points 812 and 814. Line 813 illustrates a line normal with regard to contact point 812, i.e., line 813 is perpendicular to the imaginary plane tangent to surface 805, at the point 812 where the contact surface 805 touches the moving contact bar 801 when in the on position. Line 815 illustrates a line normal with regard to contact point 814. Lines 813 and 815 intersect at point 816 which can be for example the center of section surface 817 of truncated cone 808 of moving contact bar 801. However, if non-symmetrical convex shapes were chosen for any of the surfaces 804, 805, or 808, the intersection of lines 813 and 815 may not occur at the center, or the lines 813 and 815 may not intersect at all. Angle $\beta$ is the angle between lines 813 and 815. As noted before, if non-symmetrical convex shapes were chosen for the moving contact bar 801, lines 813 and 815 may not intersect at all (and thus no angle $\beta$ would exist). Depending on dimensions of the moving contact bar 801, for example diameter of truncated cone 808, the contact points 812 and 814 may lie anywhere in the surfaces 804 and 805 of the stationary contact bar 802. Angle $\beta$ may be any angle that is greater than 0° but less than 180°.

Angle $\alpha$ is the angle between the convex surfaces 804, 805 of stationary contact bar 802, measured as described above. Angle $\alpha$ may vary and may be any angle that is greater than 0° but less than 180°. Because the surfaces 804 and 805 comprise a convex shape, the angle $\alpha$ between the surfaces 804 and 805 is the angle between two imaginary planes tangent to surfaces 804 and 805 respectively, at the two points where the contact surfaces 804 and 805 touch the moving contact bar 801 when in the on position.

When the moving contact bar 801 moves to the on position, moving contact bar 801 contacts the stationary contact bar 802 at contact points 812, 814, and the moving contact bar 801 and stationary contact bar 803 also contact each other at two contact points. The electrical contactor 800 provides two parallel current paths. The first current path is through stationary contact bar 802 and moving contact bar 801 via contact point 812 and a corresponding contact point between moving contact bar 801 and stationary contact bar 803. The second current path is through stationary contact bar 802 and moving contact bar 801 via contact point 814 and a corresponding contact point between moving contact bar 801 and stationary contact bar 803.

Figure 9:
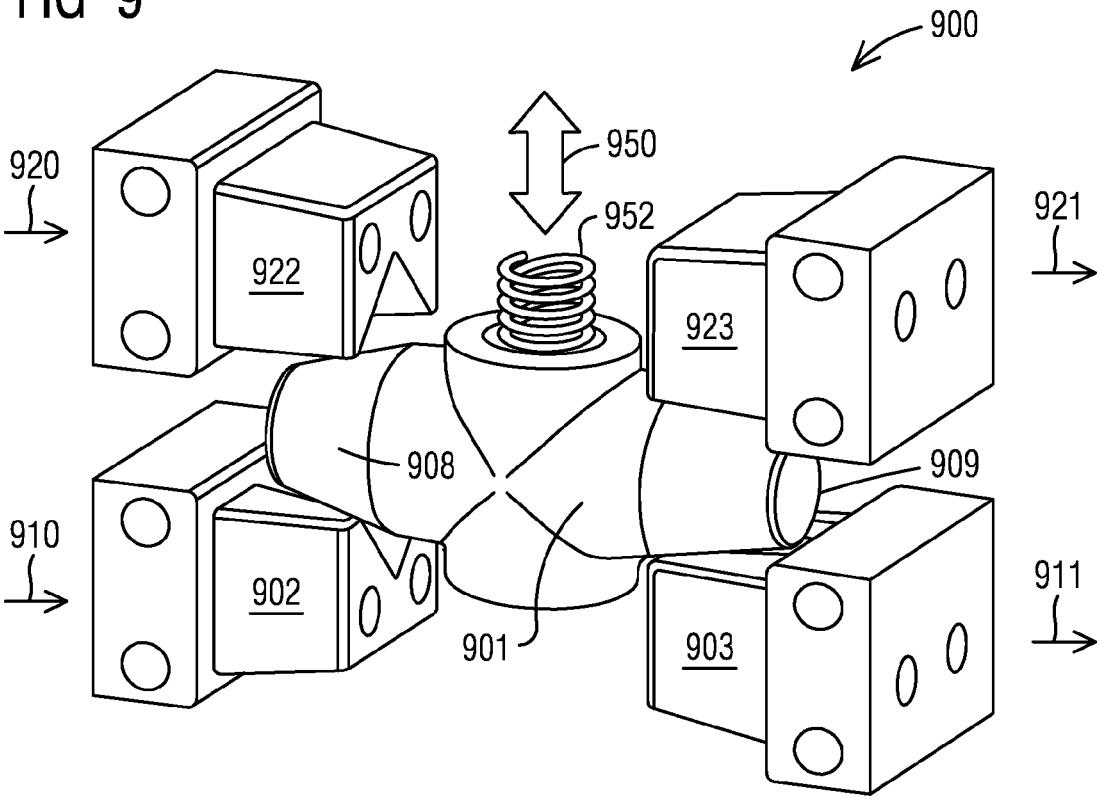
FIG. 9 illustrates a perspective view of an embodiment of a double-throw set with convex-to-convex contact surfaces.

FIG. 9 illustrates a perspective view of an embodiment of a double-throw contactor 900 with convex-to-convex contact surfaces, comprising for example cone-to-cylinder contacts. The double-throw contactor 900 comprises a moving contact bar 901 as shown in FIGS. 8A-C. The contactor 900 comprises four stationary contact bars, 902 and 903 below, and 922 and 923 above. The moving contact bar 901 includes two cones, in particular truncated cones 908, 909, one at each end of the contact bar 901. The four stationary contact bars 902, 903, 922 and 923 each have two angled surfaces which are convex. For example, stationary contact bar 902 has convex surfaces 904, 905 angled to each other. Each further stationary contact bar 903, 922, 923 has two angled surfaces which are convex. When the actuating device 950 drives the moving contact bar 901 downwards towards stationary contact bars 902 and 903, the moving contact bar 901 closes the circuit between stationary contact bars 902 and 903, and current flows from current input 910 through stationary contact bars 902 and 903 via moving contact bar 901, through four contacts points to current output 911. When the actuating device 950 drives the moving contact bar 901 upwards towards stationary contact bars 922 and 923, the moving contact bar 901 closes the circuit between stationary contact bars 922 and 923, and current flows from current input 920 through stationary contact bars 922 and 923 via moving contact bar 901, through four contacts points, to current output 921. In embodiments of a double-throw contactor 900, the moving contact bar 901 is configured to control eight points of contact. The actuating device 950 is configured to be capable of generating the same amount force in both the downwards and upwards directions. The actuating device 950 may be any appropriate actuating mechanism, for example, an electric solenoid, a manually operated lever, a cam and roller, or a pneumatic cylinder, in various embodiments with or without a spring 952.

With further reference to FIGS. 8A-C and 9, the contact bars 801, 802, 803, 901, 902, 903, 922 and 923 may be made from a metal with a relatively low electrical resistance, such as copper, in some embodiments. Since the contact bars 801, 802, 803, 901, 902, 903, 922 and 923 are not required to make or break any current, contact discs as described in the embodiments of FIGS. 2A, 2B, and 3-5 can be replaced by a protective metal plating to save cost. Metals such as silver, gold, or tin are often used for such a protective metal plating. A thin protective metal plating is sufficient to prevent corrosion and ensure contact and flow of current between the contact bars 801, 802, 803, 901, 902, 903, 922 and 923. For example, the single moving contact bar 801, 901 can comprise a protective metal plating. In some embodiments, only the truncated cones 808, 809, 908, 909 of the moving contact bar 801, 901 can comprise a protective metal plating. In other embodiments, the protective metal plating may be confined to the immediate region of the points of contact 812, 814. The angled convex surfaces of each stationary contact bar 802, 803, 902, 903, 922 and 923 can comprise a protective metal plating. For example, convex surfaces 804, 805 of stationary contact bar 802 and convex surfaces 806, 807 of contact bar 803 can comprise a protective metal plating. Accordingly, the two convex surfaces of stationary contact bars 922, 923 each can comprise a protective metal plating. In some embodiments, the complete stationary contact bars 902, 903, 922, 923 can comprise a protective metal plating. In other embodiments, the protective metal plating may be confined to the immediate region of the points of contact.

It will be apparent to anyone of ordinary skill in the art that there are many other types of convex surfaces that may be used for an electrical contactor. Convex contact surfaces may be embodied within moving contact bar(s) or stationary contact bar(s) or within both moving and stationary contact bar(s).

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An electrical contactor comprising:

a first stationary contact bar comprising a first contact surface and a second contact surface;

a single moving contact bar comprising a first contact surface and a second contact surface, and an actuating device moving the single moving contact bar via a spring towards and away from the first stationary contact bar, wherein the first and second contact surfaces of the first stationary contact bar and the first contact surface of the single moving contact bar are configured such that, when the single moving contact bar travels towards the first stationary contact bar, the first contact surface of the single moving contact bar touches the first contact surface of the first stationary contact bar in a first contact point and the second contact surface of the first stationary contact bar in a second contact point, wherein at least one of the first and second contact surfaces of the first stationary contact bar or the first contact surface of the single moving contact bar comprise a convex shape to establish the first and second contact points, and wherein the first contact surface and the second contact surface of the first stationary contact bar are planar and at an angle to each other.

2. The electrical contactor of claim 1, wherein the angle between the first contact surface and the second contact surface of the first stationary contact bar is between about 1° and about 179°.

3. The electrical contactor of claim 1, wherein the first and second contact surfaces of the single moving contact bar comprise a protective metal plating.

4. The electrical contactor of claim 1, further comprising:

a second stationary contact bar comprising a first contact surface and a second contact surface, wherein, when the single moving contact bar travels towards the first and second stationary contact bars, the second contact surface of the single moving contact bar touches the first contact surface of the second stationary contact bar in a third contact point, and the second contact surface of the second stationary contact bar in a fourth contact point, and wherein the first and second contact surfaces of the second stationary contact bar or the second contact surface of the single moving contact bar comprise a convex shape to establish the third and fourth contact points.

5. The electrical contactor of claim 4, wherein the first and second stationary contact bars each comprise a protective metal plating.

6. The electrical contactor of claim 4, further comprising a first current input on the first stationary contact bar, and a first current output on the second stationary contact bar.

7. The electrical contactor of claim 4, wherein the first contact surface and the second contact surface of the second stationary contact bar are planar and at an angle to each other.

8. The electrical contactor of claim 7, wherein the angle between the first contact surface and the second contact surface of the second stationary contact bar is between about 1° and about 179°.

9. The electrical contactor of claim 1, wherein the single moving contact bar comprises a first end and a second end, the first end comprising the first contact surface, and the second end comprising the second contact surface, the first and second contact surfaces each comprising a convex shape.

10. The electrical contactor of claim 9, wherein the first end and the second end of the single moving contact bar each comprise a shape of at least part of a hemisphere.

11. The electrical contactor of claim 4, wherein a line normal with regard to the first contact point lies at a first angle to a line normal with regard to the second contact point, and wherein a line normal with regard to the third contact point lies at a second angle to a line normal with regard to the fourth contact point.

12. The electrical contactor of claim 11, wherein the first and second angles are between about 1° and about 179°.

13. The electrical contactor of claim 4, configured as a double-throw contactor and further comprising:

a third stationary contact bar comprising a first contact surface and a second contact surface; and a fourth stationary contact bar comprising a first contact surface and a second contact surface, wherein, when the single moving contact bar travels towards the third and fourth stationary contact bars, the first contact surface of the single moving contact bar touches the first contact surface of the third stationary contact bar in a fifth contact point, and the second contact surface of the third stationary contact bar in a sixth contact point, and wherein the second contact surface of the single moving contact bar touches the first contact surface of the fourth stationary contact bar in a seventh contact point, and the second contact surface of the fourth stationary contact bar in an eighth contact point, and wherein the first and second contact surfaces of the third and fourth stationary contact bars or the first and second contact surfaces of the single moving contact bar comprise a convex shape to establish the fifth, sixth, seventh and eighth contact points.

14. The electrical contactor of claim 13, wherein the third and fourth stationary contact bars each comprise a protective metal plating.

15. The electrical contactor of claim 13, further comprising a second current input on the third stationary contact bar, and a second current output on the fourth stationary contact bar.

16. An electrical contactor comprising:

a first stationary contact bar comprising a first contact surface and a second contact surface;

a single moving contact bar comprising a first contact surface and a second contact surface, and an actuating device moving the single moving contact bar via a spring towards and away from the first stationary contact bar, wherein the first and second contact surfaces of the first stationary contact bar and the first contact surface of the single moving contact bar are configured such that, when the single moving contact bar travels towards the first stationary contact bar, the first contact surface of the single moving contact bar touches the first contact surface of the first stationary contact bar in a first contact point and the second contact surface of the first stationary contact bar in a second contact point, wherein at least one of the first and second contact surfaces of the first stationary contact bar or the first contact surface of the single moving contact bar comprise a convex shape to establish the first and second contact points, and wherein the first contact surface and the second contact surface of the first stationary contact bar are at an angle to each other, and wherein the first contact surface and¢~ the second contact surface are convex.

17. The electrical contactor of claim 16, wherein the single moving contact bar comprises a first end and a second end, the first end comprising the first contact surface and the second end comprising the second contact surface, wherein the first and second end each comprise a shape of a truncated cone.

18. The electrical contactor of claim 16, further comprising:

a second stationary contact bar comprising a first contact surface and a second contact surface, wherein, when the single moving contact bar travels towards the first and second stationary contact bars, the second contact surface of the single moving contact bar touches the first contact surface of the second stationary contact bar in a third contact point, and the second contact surface of the second stationary contact bar in a fourth contact point, and wherein the first and second contact surfaces of the second stationary contact bar or the second contact surface of the single moving contact bar comprise a convex shape to establish the third and fourth contact points, wherein the first contact surface and the second contact surface of the second stationary contact bar are at an angle to each other, and wherein the first contact surface and the second contact surface are convex.

19. The electrical contactor of claim 18, configured as a double-throw contactor and further comprising:

a third stationary contact bar comprising a first contact surface and a second contact surface; and a fourth stationary contact bar comprising a first contact surface and a second contact surface, wherein, when the single moving contact bar travels towards the third and fourth stationary contact bars, the first contact surface of the single moving contact bar touches the first contact surface of the third stationary contact bar in a fifth contact point, and the second contact surface of the third stationary contact bar in a sixth contact point, and wherein the second contact surface of the single moving contact bar touches the first contact surface of the fourth stationary contact bar in a seventh contact point, and the second contact surface of the fourth stationary contact bar in an eighth contact point, and wherein the first and second contact surfaces of the third and fourth stationary contact bars comprise a convex shape to establish the fifth, sixth, seventh and eighth contact points.

* * * * *